US008176739B2

(12) United States Patent
Evulet et al.

(10) Patent No.: US 8,176,739 B2
(45) Date of Patent: May 15, 2012

(54) COANDA INJECTION SYSTEM FOR AXIALLY STAGED LOW EMISSION COMBUSTORS

(75) Inventors: Andrei Tristan Evulet, Clifton Park, NY (US); Balachandar Varatharajan, Cincinnati, OH (US); Gilbert Otto Kraemer, Greer, SC (US); Ahmed Mostafa ElKady, Niskayuna, NY (US); Benjamin Paul Lacy, Greer, SC (US)

(73) Assignee: General Electric Company, Niskayuna, NY (US)

( * ) Notice: Subject to any disclaimer, the term of this patent is extended or adjusted under 35 U.S.C. 154(b) by 971 days.

(21) Appl. No.: 12/175,050

(22) Filed: Jul. 17, 2008

(65) Prior Publication Data

US 2010/0011771 A1 Jan. 21, 2010

(51) Int. Cl.
*F02C 1/00* (2006.01)
*F02G 3/00* (2006.01)

(52) U.S. Cl. ..... 60/733; 60/746; 60/752; 60/737; 60/740

(58) Field of Classification Search ..... 60/733, 60/746, 747, 804, 39.37, 39.23, 759, 737, 60/740, 752–758, 760, 734
See application file for complete search history.

(56) References Cited

U.S. PATENT DOCUMENTS 3,851,467 A * 12/1974 Sherman et al. ..... 60/750
3,872,664 A * 3/1975 Lohmann et al. ..... 60/746
3,876,362 A 4/1975 Hirose
4,054,028 A * 10/1977 Kawaguchi ..... 60/39.23
4,265,615 A * 5/1981 Lohmann et al. ..... 431/353
4,301,657 A * 11/1981 Penny ..... 60/748
5,069,029 A * 12/1991 Kuroda et al. ..... 60/776
5,121,597 A * 6/1992 Urushidani et al. ..... 60/778
5,127,229 A * 7/1992 Ishibashi et al. ..... 60/747
5,311,742 A * 5/1994 Izumi et al. ..... 60/742
5,319,935 A * 6/1994 Toon et al. ..... 60/733
5,490,380 A * 2/1996 Marshall ..... 60/776
5,575,154 A * 11/1996 Loprinzo ..... 60/746
5,636,510 A * 6/1997 Beer et al. ..... 60/39.23
5,657,632 A * 8/1997 Foss ..... 60/742
5,749,219 A * 5/1998 DuBell ..... 60/804
5,797,267 A * 8/1998 Richards ..... 60/737
(Continued)

FOREIGN PATENT DOCUMENTS

EP 0106659 A2 4/1984
(Continued)

*Primary Examiner* — William H Rodriguez
(74) *Attorney, Agent, or Firm* — Ann M. Agosti

(57) ABSTRACT

The low emission combustor includes a combustor housing defining a combustion chamber having a plurality of combustion zones. A liner sleeve is disposed in the combustion housing with a gap formed between the liner sleeve and the combustor housing. A secondary nozzle is disposed along a centerline of the combustion chamber and configured to inject a first fluid comprising air, at least one diluent, fuel, or combinations thereof to a downstream side of a first combustion zone among the plurality of combustion zones. A plurality of primary fuel nozzles is disposed proximate to an upstream side of the combustion chamber and located around the secondary nozzle and configured to inject a second fluid comprising air and fuel to an upstream side of the first combustion zone. The combustor also includes a plurality of tertiary coanda nozzles. Each tertiary coanda nozzle is coupled to a respective dilution hole. The tertiary coanda nozzles are configured to inject a third fluid comprising air, at least one other diluent, fuel, or combinations thereof to one or more remaining combustion zones among the plurality of combustion zones.

15 Claims, 5 Drawing Sheets

U.S. PATENT DOCUMENTS

| | | | | |
|---|---|---|---|---|
| 5,802,854 | A | 9/1998 | Maeda et al. | |
| 6,070,411 | A * | 6/2000 | Iwai et al. | 60/737 |
| 6,105,370 | A * | 8/2000 | Weber | 60/733 |
| 6,209,325 | B1 * | 4/2001 | Alkabie | 60/737 |
| 6,240,732 | B1 * | 6/2001 | Allan | 60/739 |
| 6,298,667 | B1 * | 10/2001 | Glynn et al. | 60/737 |
| 6,332,313 | B1 * | 12/2001 | Willis et al. | 60/776 |
| 6,691,515 | B2 * | 2/2004 | Verdouw et al. | 60/737 |
| 6,871,503 | B1 * | 3/2005 | Inoue et al. | 60/776 |
| 6,874,323 | B2 | 4/2005 | Stuttaford | |
| 6,959,550 | B2 * | 11/2005 | Freeman et al. | 60/725 |
| 7,024,862 | B2 * | 4/2006 | Miyake et al. | 60/773 |
| 7,162,875 | B2 * | 1/2007 | Fletcher et al. | 60/773 |
| 7,739,867 | B2 * | 6/2010 | Kenyon et al. | 60/247 |
| 7,874,157 | B2 * | 1/2011 | Evulet et al. | 60/740 |
| 7,886,545 | B2 * | 2/2011 | Lacy et al. | 60/804 |
| 2002/0152740 | A1 * | 10/2002 | Suenaga et al. | 60/39.23 |
| 2002/0184889 | A1 * | 12/2002 | Calvez et al. | 60/796 |
| 2003/0150216 | A1 * | 8/2003 | O'Beck et al. | 60/775 |
| 2010/0170254 | A1 * | 7/2010 | Venkataraman et al. | 60/746 |
| 2010/0242482 | A1 * | 9/2010 | Kraemer et al. | 60/746 |

FOREIGN PATENT DOCUMENTS

| | | | |
|---|---|---|---|
| WO | 01/35022 | A1 | 5/2001 |

* cited by examiner

COANDA INJECTION SYSTEM FOR AXIALLY STAGED LOW EMISSION COMBUSTORS

STATEMENT OF FEDERALLY FUNDED RESEARCH

This invention was made with Government support under grant number E.I. #C391520602379936A10 awarded by the Department of Energy under DOE Cooperative Agreement DE-FC26-05NT42643. The Government has certain rights in the invention.

BACKGROUND

The invention relates generally to combustors, and more particularly to a coanda injection system for axially staged low emission combustion devices.

A gas turbine employed in a gas turbine plant or a combined cycle plant is operated to achieve higher operational efficiency under higher temperature and higher pressure conditions, and this tends to increase emissions (for example, NOx) in an exhaust gas stream. Although various factors for generation of NOx are known, the dominant one is flame temperature in a combustor. NOx emissions are directly proportional to the flame temperature in a combustor.

There are some conventional techniques for reducing NOx in an exhaust gas stream from a combustor. One conventionally adopted method involves injection of steam or water into the high-temperature combustion area in a combustor for reducing the flame temperature during the combustion. Although this method is easy to perform, it suffers from problems in that a large amount of steam or water is required, resulting in reduced plant efficiency. Additionally, injection of a large amount of steam or water into a combustor increases combustion vibrations, partial combustion products, and reduces life.

Taking the above defects into consideration, a dry type premixed lean combustion method has been developed, in which fuel and combustion air are injected in a premixed mode and burned under lean fuel conditions in a single stage combustor. Even though reduction of NOx emissions is achieved, the operability range of the combustor is reduced due to the premixed injection mode. The usage of a single stage combustion in a combustor may not guarantee lower NOx emissions.

Multi-stage combustion may be used to achieve reduced NOx emissions and better operability range of a combustor. In such conventional systems, the additional premixers are provided in an environment of the later stages of the combustor having reacting gas flows from one or more primary nozzles. The presence of premixers disturbs the flow pattern of hot gases in the later stages of the combustor resulting in higher pressure drops across the combustor. Cooling of such premixers is also difficult due to elevated temperatures and the introduction of flammable mixtures in later stages of combustors.

Accordingly there is a need for a system that is employed in gas turbines that achieves reduced NOx emissions from the axially staged combustor without compromising the dynamics and operability of the combustor.

BRIEF DESCRIPTION

In accordance with one exemplary embodiment of the present invention, a low emission combustor is disclosed. The combustor includes a combustor housing defining a combustion chamber having a plurality of combustion zones. A liner sleeve is disposed in the combustion housing with a gap formed between the liner sleeve and the combustor housing. A secondary nozzle is disposed along a centerline of the combustion chamber and configured to inject a first fluid comprising air, at least one diluent, fuel, or combinations thereof to a downstream side of a first combustion zone among the plurality of combustion zones. A plurality of primary fuel nozzles are disposed proximate to an upstream side of the combustion chamber and located around the secondary nozzle and configured to inject a second fluid comprising air and fuel to an upstream side of the first combustion zone. The combustor also includes a plurality of tertiary coanda nozzles. Each tertiary coanda nozzle is coupled to a respective dilution hole. The tertiary coanda nozzles are configured to inject a third fluid comprising air, at least one other diluent, fuel, or combinations thereof to one or more remaining combustion zones among the plurality of combustion zones. The one or more remaining combustion zones are located to a downstream side of the first combustion zone.

In accordance with another exemplary embodiment, a gas turbine having a low emission combustor is disclosed.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
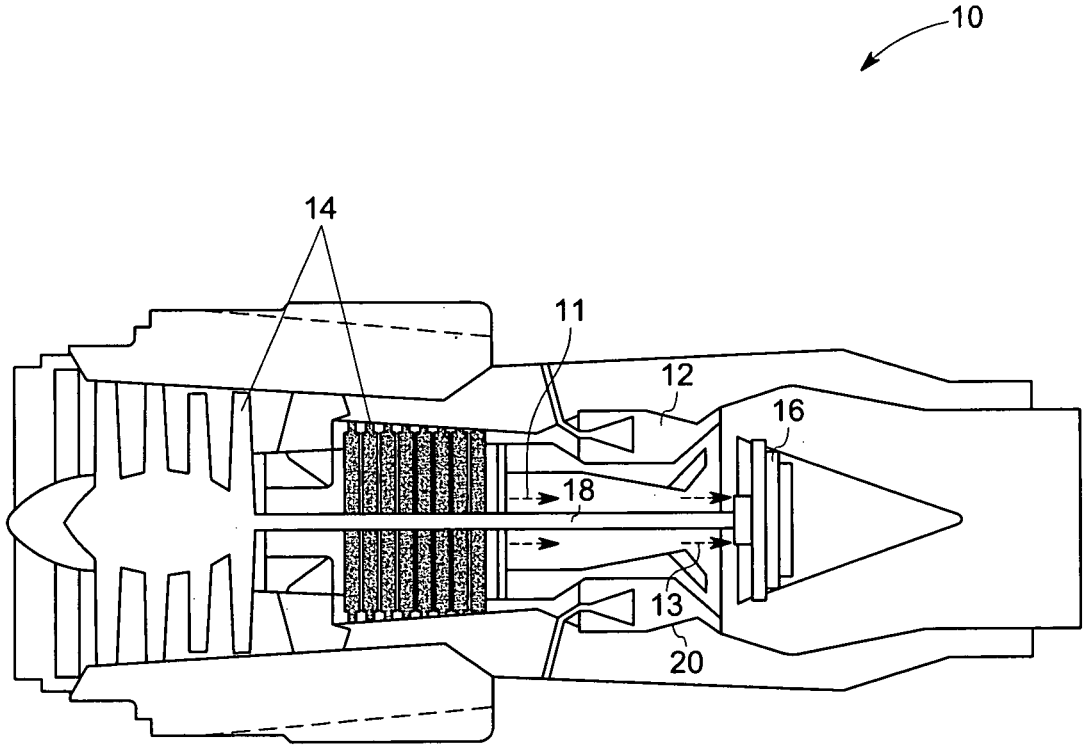
FIG. 1 is a diagrammatical illustration of a gas turbine having a low emission combustor nozzle in accordance with an exemplary embodiment of the present invention.

As discussed in detail below, certain embodiments of the present invention disclose a low emission combustor having a combustor housing defining a combustion chamber including a plurality of combustion zones. A liner sleeve is disposed in the combustion housing with a gap formed between the liner sleeve and the combustor housing. A liner having a plurality of dilution holes is disposed within the liner sleeve. A secondary nozzle is disposed along a center line of the combustion chamber and configured to inject a first fluid including air, at least one diluent, fuel, or combinations thereof (also referred to as "pilot injection") to a downstream side of a first combustion zone among the plurality of combustion zones. A plurality of primary nozzles are disposed proximate to an upstream side of the combustion chamber and located around the secondary nozzle and configured to inject a second fluid including air and fuel (also referred to as "main injection") to an upstream side of the first combustion zone. The amount of the first fluid is typically less than the second fluid.

The combustor also includes a plurality of coanda tertiary nozzles, each coanda tertiary nozzle coupled to a corresponding dilution hole. The coanda tertiary nozzle is configured to inject a third fluid including air, at least one other diluent, fuel, or combinations thereof to one or more remaining combustion zones (later stages) among the plurality of combustion zones located downstream of the first combustion zone. The coanda tertiary nozzles operate in variable premix mode based on the fuel supply to the coanda tertiary nozzles. The coanda tertiary nozzle includes a coanda device configured to mix the air, fuel and diluents. The coanda tertiary nozzles facilitate to provide heat in the later stages of the combustor resulting in improvement of operability, and emissions abatement. The provision of the coanda tertiary nozzles on the liner facilitates to minimize the pressure drop in the later stages of the combustor and thus maximize efficiency across the combustor. It should be noted herein that in the embodiments discussed below, even though it may not be explicitly stated, "air" may also be considered to mean a combination of air and diluents. Similarly "fuel" may also be considered to mean a combination of fuel and diluents.

As discussed in detail below, embodiments of the present invention function to reduce emissions in combustion processes in various applications such as in ground power gas turbine combustors, gas ranges and internal combustion engines. In particular, the present invention discloses a low emission combustor having a plurality of axial combustion zones/stages provided with a plurality of coanda nozzles configured to allow mixing of the air, diluents, and fuel based on a "coanda effect". Turning now to drawings and referring first to FIG. 1, a gas turbine 10 having a low emission combustor 12 is illustrated. The gas turbine 10 includes a compressor 14 configured to compress ambient air. The combustor 12 is in flow communication with the compressor 14 and is configured to receive compressed air 11 from the compressor 14 and to combust a fuel stream to generate a combustor exit gas stream 13. In the illustrated embodiment, the combustor 12 includes a combustor housing 20 defining a combustion area. In one embodiment, the combustor 12 includes a can combustor. In an alternate embodiment, the combustor 12 includes a can-annular combustor or a purely annular combustor. In addition, the gas turbine 10 includes a turbine 16 located downstream of the combustor 12. The turbine 16 is configured to expand the combustor exit gas stream 13 to drive an external load. In the illustrated embodiment, the compressor 14 is driven by the power generated by the turbine 16 via a shaft 18.

Figure 2:
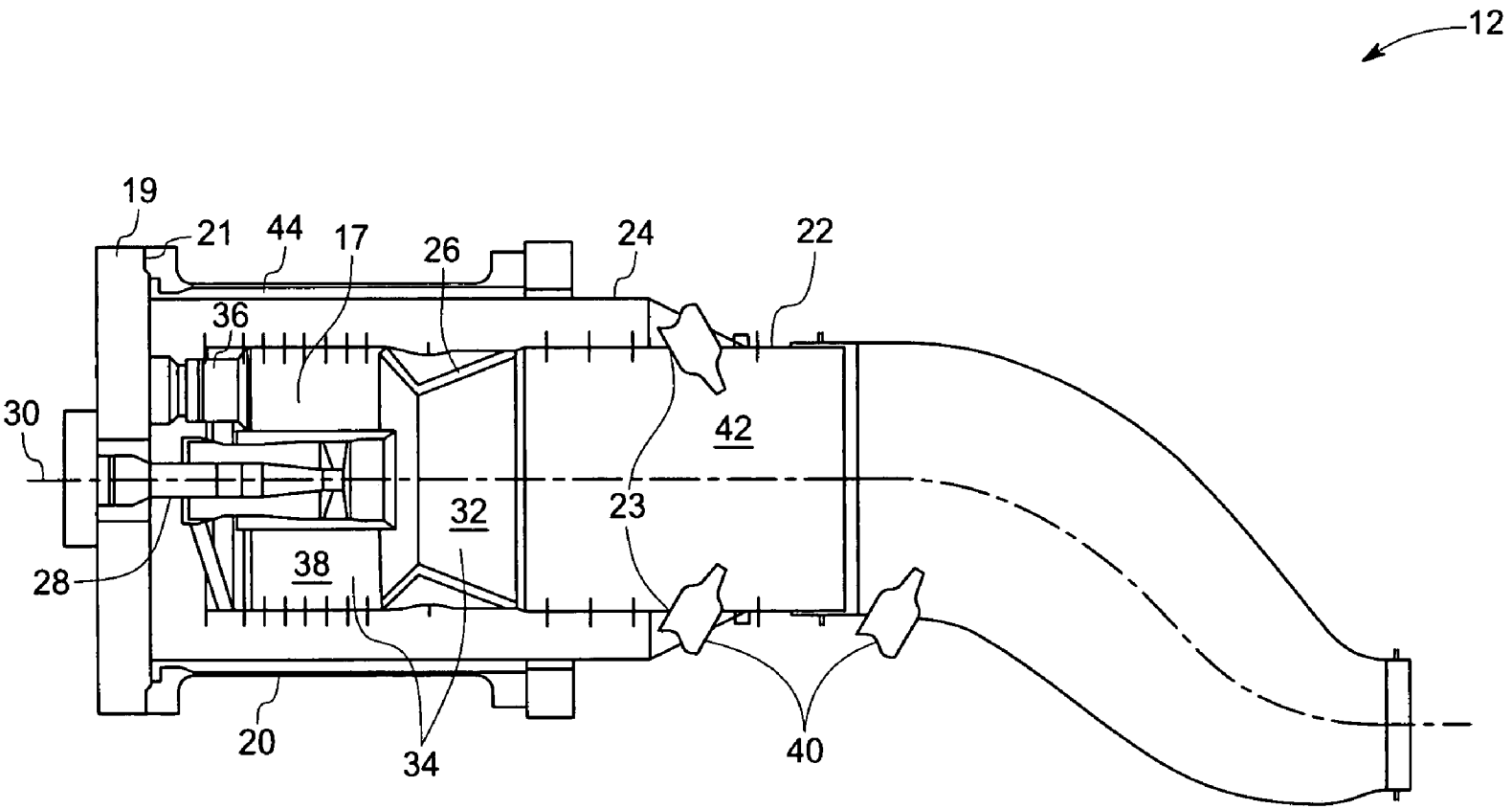
FIG. 2 is a diagrammatical illustration of a combustor having a plurality of coanda tertiary nozzles in accordance with an exemplary embodiment of the present invention.

Referring to FIG. 2, a low emission combustor 12 in accordance with the aspects of FIG. 1 is illustrated. The exemplary combustor 12 includes a combustor housing 20 defining a combustion chamber 17. A cover assembly 19 is provided on one end 21 of the combustor housing 14. A combustion liner 22 is disposed within a flow sleeve 24 provided in the combustor housing 20. A plurality of dilution holes 23 is provided in the combustion liner 22. A venturi assembly 26 is disposed inside the combustion liner 22.

A secondary nozzle 28 (also referred to as "pilot nozzle") is disposed aligned with a centerline 30 of the combustion chamber 17. The secondary nozzle 28 is configured to mix air and the fuel and inject a first fluid (also referred to as "pilot fluid") to a downstream side 32 of a first combustion zone 34 of the combustion chamber 17. The first combustion zone 34 is designed to operate in lean conditions for minimization of emissions such as NOx. In certain embodiments, the fuel may include hydrocarbons, natural gas, or high hydrogen gas, or hydrogen, or biogas, or carbon monoxide, or syngas, or inert gas, or water vapor, or oxidizers along with predetermined amount of diluents. Diluents may include nitrogen, carbon dioxide, water, steam, or the like. In one embodiment, the secondary nozzle 28 is a coanda type nozzle. A plurality of primary nozzles 36 is disposed on an upstream side of the combustion chamber 17 and located around the secondary nozzle 28 and configured to inject a second fluid (also referred to as "main fluid") including air, fuel, and/or diluents to an upstream side 38 of the first combustion zone 34 of the combustion chamber 17. In one embodiment, the primary nozzle 34 may be a coanda nozzle. It should be noted herein that the amount of first mixture of air and fuel is less than the amount of second mixture of air and fuel. It should be noted herein that in some embodiments, the combustor 12 does not include a secondary nozzle.

In the illustrated embodiment, the combustor 12 is operated in a premixed mode. Fuel feed is split between the primary nozzles 36 and the secondary nozzles 28. Flame resides completely within the downstream combustion zone 32 of the combustion chamber 16. The venturi assembly 26 enhances fuel-air mixing during the premixed mode for the fluids entering the downstream combustion zone 32.

In the exemplary embodiment, a plurality of coanda tertiary nozzles 40 is also provided to the combustor 12. Each coanda tertiary nozzle 40 is coupled to a respective dilution hole 23 provided in the liner 22. The tertiary nozzles 40 are configured to inject a third fluid including air, fuel, one or more diluents, or combination thereof to a second combustion zone/stage 42 disposed to a downstream side of the first combustion zone 34. The number of zones/stages in the combustor may vary depending upon the application. The coanda tertiary nozzles 40 are configured to allow mixing of the fuel and air based on a "coanda effect". As used herein, the term "coanda effect" refers to the tendency of a stream of fluid to attach itself to a nearby surface and to remain attached even when the surface curves away from the original direction of fluid motion. A gap 44 formed between the liner 22 and combustor housing 20 allows passage of air to the tertiary nozzles 40 provided to the dilution holes 23 of the liner 22. In particular, the nozzle 40 employs the coanda effect to enhance the mixing efficiency of the device that will be described below with reference to subsequent figures. It should be noted herein that in some embodiments, the liner 22 may not be provided with dilution holes. In such embodiments, other suitable provisions may be provided in the liner 22 to accommodate the coanda tertiary nozzles 40. The provision of the coanda tertiary nozzles 40 to the liner 22 does not disturb the flow pattern of hot gases in the later stages of the combustor resulting in lower pressure drops across the combustor. It should be noted herein that the coanda type tertiary nozzles 40 may be used for the later stages of the combustor 12 regardless of the type of the primary and secondary nozzles 36, and 28 or whether there is even a secondary nozzle used in the combustor.

Figure 3:
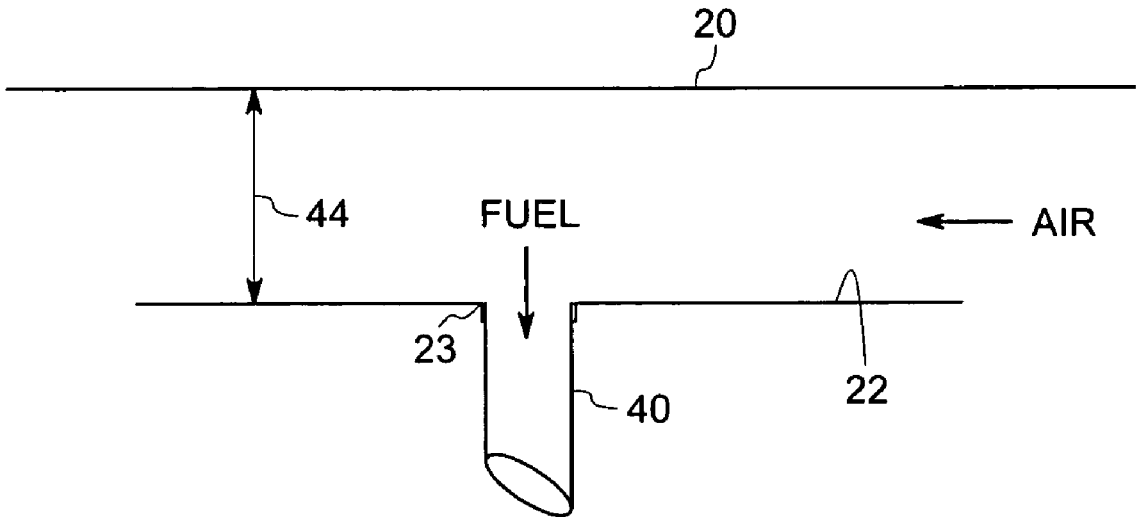
FIG. 3 is a diagrammatical view of a coanda tertiary nozzle in accordance with an exemplary embodiment of the present invention.

Referring to FIG. 3, one coanda tertiary nozzle 40 disposed in the combustor is illustrated. As discussed above, the combustion liner 22 is disposed within the flow sleeve provided in the combustor housing 20. The plurality of dilution holes 23 is provided in the combustion liner 22. In the illustrated embodiment, one coanda tertiary nozzle 40 is shown coupled to a dilution hole 23. Air and/or diluents flows to the coanda tertiary nozzle 40 via the gap 44 formed between the liner sleeve and the combustor housing 20. The coanda tertiary nozzle 40 is configured to inject a third fluid comprising air, fuel, or combinations thereof to one or more downstream combustion zones (e.g. the second combustion zone/stage 42 shown in FIG. 2). The nozzles 40 are designed to allow mixing of the fuel and air based on coanda effect discussed in greater detail with reference to subsequent figures. In one embodiment, the coanda tertiary nozzle 40 provides a mixture of air and fuel to the downstream combustion zone when fuel is supplied to the coanda tertiary nozzle 40. When fuel is supplied to the coanda tertiary nozzles 40, the effective area of the nozzles 40 change accordingly and more air is entrained with the fuel, thus ensuring a good mixing and supply of air-fuel mixture to the downstream combustion zone. When fuel is not supplied to the coanda tertiary nozzle 40, the coanda tertiary nozzle 40 injects only air to the downstream combustion zone. In other words, the nozzle 40 acts as dilution source during certain operating conditions. The premixed injection from the coanda tertiary nozzle 40 may be provided depending on the operating conditions.

It is known conventionally to use multi-stage combustion to achieve better operability range. However, it is difficult to provide additional premixers in later stages of combustors due to higher pressure drops and the need for placing premixers in an environment including reacting gas flows from the primary nozzles. Cooling of such premixers is also difficult due to elevated temperatures and introduction of flammable mixtures in later stages of combustors. The provision of the exemplary coanda nozzles will minimize the pressure drop and thus maximize efficiency across the combustor. The coanda nozzles act as dilution devices when fuel is not delivered to the nozzles. Therefore these nozzles do not need special cooling. The coanda nozzles do not hold flame, and will not disturb the combustion flow. The coanda nozzles are also virtually flash back resistant. The coanda nozzles provides enhanced premixing of air and fuel and can be easily retrofitted to existing dilution holes in the liner of combustor. The shearing action of the flowing fuel in the air stream forces (pulls along) more air through the coanda nozzle. Thus more air flows through the coanda nozzle resulting in lower local flame temperature and better mixing of air and fuel. When no fuel is supplied to the coanda tertiary nozzles 40, more air is supplied through the primary fuel nozzles, thereby reducing the local fuel air ratio in the combustor. The local flame temperature is reduced resulting in reduction of the local thermal NOx production. When axial staging is used in combustors, more air is forced through the Coanda tertiary nozzles, and thereby reducing the thermal NOx production.

Figure 4:
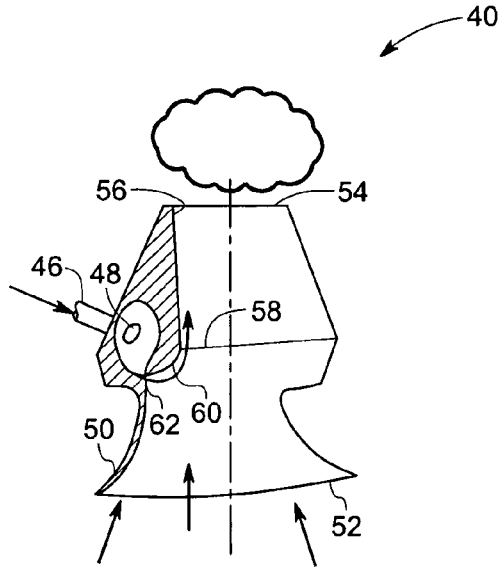
FIG. 4 is a diagrammatical illustration of a coanda tertiary nozzle in accordance with an exemplary embodiment of the present invention.

FIG. 4 is a diagrammatical illustration of an exemplary configuration of the coanda tertiary nozzle 40 employed in the combustors of FIGS. 2 and 3. In the embodiment illustrated in FIG. 4, the coanda tertiary nozzle 40 includes a fuel line 46 for directing the fuel inside a fuel plenum 48 of the coanda tertiary nozzle 40. An air inlet nozzle profile of the coanda tertiary nozzle 40 and an air inlet are represented by reference numerals 50 and 52. In addition, the nozzle 40 includes a nozzle outlet 54, a diffuser wall 56 and a throat area 58. The nozzle 40 receives the fuel from the fuel plenum 48 and the fuel is directed to flow over a pre-determined profile 60 or over a set of slots or orifices through a fuel outlet annulus 62. Subsequently, the fuel is mixed with incoming air from the air inlet 52 to form a fuel-air mixture. The degree of premixing is controlled by a fuel type, or geometry of the profile, or a fuel pressure, or temperature of the fuel, or temperature of the air, or length of premixing, or a fuel injection velocity, or combinations thereof. In some embodiments, a plurality of plenums 48 or fuel slots/orifices could be utilized to inject different combinations of fuel and/or diluents.

Figure 5:
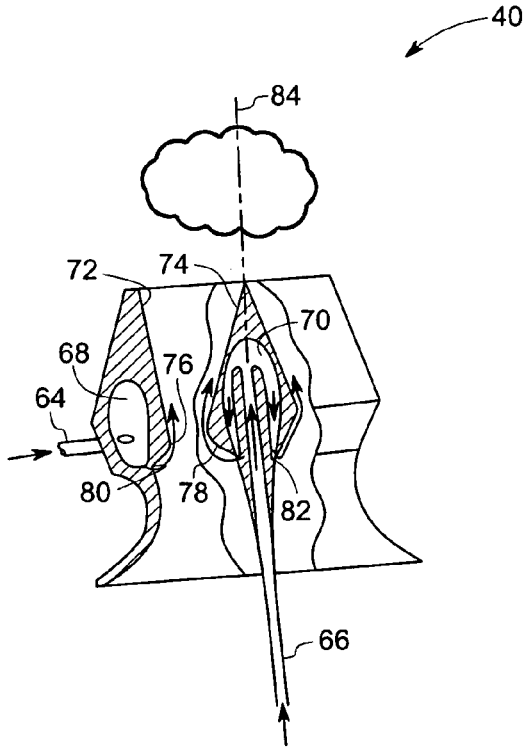
FIG. 5 is a diagrammatical illustration of a coanda tertiary nozzle in accordance with an exemplary embodiment of the present invention.

FIG. 5 is a diagrammatical illustration of another exemplary configuration of the coanda tertiary nozzle 40 employed in the combustors of FIGS. 2 and 3, for substantially larger air flows and fuel staging capabilities. In the embodiment illustrated in FIG. 5, the coanda tertiary nozzle 40 includes a dual-mixing configuration nozzle that facilitates wall and center mixing. The nozzle 40 includes two fuel inlet lines 64 and 66 and two fuel plenums 68 and 70 to independently provide the fuel for wall and center mixing. Further, a diffuser wall and a center body are represented by reference numerals 72 and 74 respectively. The fuel from the fuel plenums 68 and 70 is directed to flow over the pre-determined profiles 76 and 78 via two fuel outlets 80 and 82. The nozzle 40 receives an airflow along a centerline 84 of the nozzle 40 and facilitates mixing of the air and fuel within the nozzle 40. The predetermined profiles 76 and 78 may be designed to facilitate the mixing within the premixing device based on the coanda effect. In the illustrated embodiment, the pre-determined profiles 76 and 78 facilitate attachment of the introduced fuel to the profiles 76 and 78 to form a fuel boundary layer. Additionally, the fuel boundary layer formed adjacent the predetermined profiles 76 and 78 facilitates air entrainment thereby enhancing the mixing efficiency of the nozzle 40. The coanda effect generated within the nozzle 40 facilitates a relatively high degree of premixing prior to combustion thereby substantially reducing pollutant emissions from the combustion system. In particular, the ability of the fuel to attach to the profiles 76 and 78 due to the coanda effect and subsequent air entrainment results in a relatively high premixing efficiency of the nozzle 40 before combustion.

Figure 6:
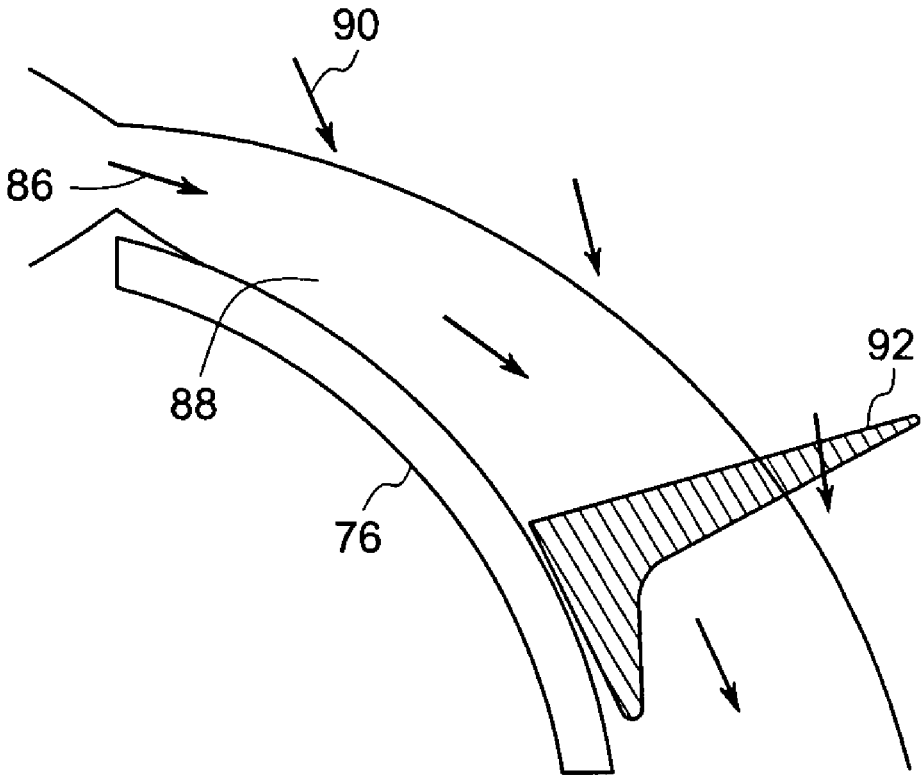
FIG. 6 is a diagrammatical illustration of the formation of fuel boundary layer adjacent a profile in a coanda tertiary nozzle based upon a coanda effect in accordance with an exemplary embodiment of the present invention.

FIG. 6 is a diagrammatical illustration of the formation of a fuel boundary layer adjacent the profile 76 in the coanda tertiary nozzle 40 of FIG. 5 based upon the coanda effect. In the illustrated embodiment, a fuel flow 86 attaches to the profile 76 and remains attached even when the surface of the profile 76 curves away from the initial fuel flow direction. More specifically, as the fuel flow 86 accelerates to balance the momentum transfer, there is a pressure difference across the flow, which deflects the fuel flow 86 closer to the surface of the profile 76. As will be appreciated by one skilled in the art, as the fuel 86 moves across the profile 76, a certain amount of skin friction occurs between the fuel flow 86 and the profile 76. This resistance to the flow deflects the fuel 86 towards the profile 76 thereby causing it to stick to the profile 76. Further, a fuel boundary layer 88 formed by this mechanism entrains an incoming airflow 90 to form a shear layer 92 with the fuel boundary layer 88 to promote mixing of the airflow 90 and the fuel 86. Furthermore, the shear layer 92 formed by the detachment and mixing of the fuel boundary layer 88 with the entrained air 90 results in a uniform mixture.

More details pertaining to coanda devices are explained in greater detail with reference to U.S. application Ser. No. 11/273,212 incorporated herein by reference. The various aspects of the tertiary nozzle 40 described hereinabove have utility in different applications such as combustors employed in gas turbines and heating devices such as furnaces. In addition, the nozzles 40 may be employed in gas range appliances. In certain embodiments, the nozzles 40 may be employed in aircraft engine hydrogen combustors and other gas turbine combustors for aero-derivatives and heavy-duty machines.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A low emission combustor, comprising:

a combustor housing defining a combustion chamber comprising a plurality of combustion zones;

a liner sleeve disposed in the combustor housing with a gap formed between the liner sleeve and the combustor housing;

a liner disposed within the liner sleeve; wherein the liner comprises a plurality of dilution holes;

a secondary nozzle disposed along a center line of the combustion chamber and configured to inject a first fluid comprising air, fuel, or combinations thereof to a downstream side of a first combustion zone among the plurality of combustion zones;

a plurality of primary fuel nozzles disposed proximate to an upstream side of the combustion chamber and located around the secondary nozzle and configured to inject a second fluid comprising air and fuel to an upstream side of the first combustion zone; and a plurality of coanda tertiary nozzles, each coanda tertiary nozzle coupled to a respective dilution hole, wherein the coanda tertiary nozzles are configured to inject a third fluid comprising air, fuel, or combinations thereof to one or more remaining combustion zones among the plurality of combustion zones, wherein the one or more remaining combustion zones are located to a downstream side of the first combustion zone, wherein each of the tertiary coanda nozzles comprises a predetermined profile disposed proximate to a fuel plenum, wherein the profile is configured to facilitate attachment of a fuel introduced via the fuel plenum to the profile to form a fuel boundary layer and to entrain incoming air from an air inlet to promote premixing of air and fuel.

2. The combustor of claim 1, wherein the secondary nozzle comprises a coanda nozzle.

3. The combustor of claim 1, wherein air is supplied to the air inlet via the gap formed between the liner sleeve and the combustor housing.

4. The combustor of claim 1, wherein the predetermined profile deflects the supplied fuel towards the profile via a coanda effect.

5. The combustor of claim 1, wherein the air supplied through the air inlet forms a shear layer with the fuel boundary layer to facilitate premixing of air and fuel and to substantially reduce pollutant emissions.

6. The combustor of claim 1, wherein a degree of premixing is controlled by a fuel type, or a geometry of the predetermined profile, or a fuel pressure, or a temperature of the fuel, or a temperature of the air, or a length of premixing, or a fuel injection velocity, or combinations thereof.

7. The combustor of claim 1, wherein the fuel comprises hydrocarbons, natural gas, or high hydrogen gas, or hydrogen, or bio gas, or carbon monoxide, or a syngas, or a inert gas, or water vapor, or oxidizers.

8. The combustor of claim 1, wherein the coanda tertiary nozzles are configured to inject a third fluid comprising air and fuel to one or more remaining combustion zones among the plurality of combustion zones when the fuel is supplied to the coanda tertiary nozzles.

9. The combustor of claim 1, wherein the coanda tertiary nozzles are configured to inject air to one or more remaining combustion zones among the plurality of combustion zones when the fuel is not supplied to the coanda tertiary nozzles.

10. A gas turbine, comprising:

a compressor configured to compress ambient air;

a combustor in flow communication with the compressor, the combustor being configured to receive compressed air from the compressor assembly and to combust a fuel stream to generate a combustor exit gas stream; the combustor comprising:

a combustor housing defining a combustion chamber comprising a plurality of combustion zones;

a liner sleeve disposed in the combustion combustor housing with a gap formed between the liner sleeve and the combustor housing;

a liner disposed within the liner sleeve; wherein the liner comprises a plurality of dilution holes;

a secondary nozzle disposed along a center line of the combustion chamber and configured to inject a first fluid comprising air, fuel, or combinations thereof to a downstream side of a first combustion zone among the plurality of combustion zones;

a plurality of primary fuel nozzles disposed proximate to an upstream side of the combustion chamber and located around the secondary nozzle and configured to inject a second fluid comprising air and fuel to an upstream side of the first combustion zone; and a plurality of coanda tertiary nozzles, each coanda tertiary nozzle coupled to a respective dilution hole, wherein the coanda tertiary nozzles are configured to inject a third fluid comprising air, fuel, or combinations thereof to one or more remaining combustion zones among the plurality of combustion zones, wherein the one or more remaining combustion zones are located to a downstream side of the first combustion zone, wherein each of the tertiary coanda nozzles comprises a predetermined profile disposed proximate to a fuel plenum, wherein the profile is configured to facilitate attachment of a fuel introduced via the fuel plenum to the profile to form a fuel boundary layer and to entrain incoming air from an air inlet to promote premixing of air and fuel.

11. The gas turbine of claim 10, wherein air is supplied to the air inlet via the gap formed between the liner sleeve and the combustor housing.

12. A low emission combustor, comprising:

a combustor housing defining a combustion chamber comprising a plurality of combustion zones;

a liner sleeve disposed in the combustor housing with a gap formed between the liner sleeve and the combustor housing;

a liner disposed within the liner sleeve; wherein the liner comprises a plurality of dilution holes;

a secondary nozzle disposed along a center line of the combustion chamber and configured to inject a first fluid comprising air, fuel, or combinations thereof to a downstream side of a first combustion zone among the plurality of combustion zones;

a plurality of primary fuel nozzles disposed proximate to an upstream side of the combustion chamber and located around the secondary nozzle and configured to inject a second fluid comprising air and fuel to an upstream side of the first combustion zone; and a plurality of coanda tertiary nozzles, each coanda tertiary nozzle coupled to a respective dilution hole, wherein the coanda tertiary nozzles are configured to inject a third fluid comprising air and fuel to one or more remaining combustion zones among the plurality of combustion zones when fuel is supplied to the coanda tertiary nozzles, or to inject air to one or more remaining combustion zones among the plurality of combustion zones when fuel is not supplied to the coanda tertiary nozzles, wherein the one or more remaining combustion zones are located to a downstream side of the first combustion zone, wherein each of the tertiary coanda nozzles comprises a predetermined profile disposed proximate to a fuel plenum, wherein the profile is configured to facilitate attachment of a fuel introduced via the fuel plenum to the profile to form a fuel boundary layer and to entrain incoming air from an air inlet to promote premixing of air and fuel.

13. The combustor of claim 12, wherein air is supplied to the air inlet via the gap formed between the liner sleeve and the combustor housing.

14. A low emission combustor, comprising:

a combustor housing defining a combustion chamber comprising a plurality of combustion zones;

a liner sleeve disposed in the combustion combustor housing with a gap formed between the liner sleeve and the combustor housing;

a liner disposed within the liner sleeve; wherein the liner comprises a plurality of dilution holes;

a secondary nozzle disposed along a center line of the combustion chamber and configured to inject a first fluid comprising air, at least one diluent; fuel, or combinations thereof to a downstream side of a first combustion zone among the plurality of combustion zones; a plurality of primary fuel nozzles disposed proximate to an upstream side of the combustion chamber and located around the secondary nozzle and configured to inject a second fluid comprising air and fuel to an upstream side of the first combustion zone; and a plurality of coanda tertiary nozzles, each coanda tertiary nozzle coupled to a respective dilution hole, wherein the coanda tertiary nozzles are configured to inject a third fluid comprising air, at least one another diluent; fuel, or combinations thereof to one or more remaining combustion zones among the plurality of combustion zones, wherein the one or more remaining combustion zones are located to a downstream side of the first combustion zone, wherein each of the tertiary coanda nozzles comprises a predetermined profile disposed proximate to a fuel plenum, wherein the profile is configured to facilitate attachment of a fuel introduced via the fuel plenum to the profile to form a fuel boundary layer and to entrain incoming air from an air inlet to promote premixing of air and fuel.

15. A low emission combustor, comprising:

a combustor housing defining a combustion chamber comprising a plurality of combustion zones;

a liner sleeve disposed in the combustor housing with a gap formed between the liner sleeve and the combustor housing;

a liner disposed within the liner sleeve;

a plurality of fuel nozzles disposed proximate to an upstream side of the combustion chamber and configured to inject a fluid comprising air and fuel to an upstream side of the first combustion zone; and a plurality of coanda nozzles provided to the liner, wherein the coanda nozzles are configured to inject a-another fluid comprising air, fuel, or combinations thereof to one or more remaining combustion zones among the plurality of combustion zones, wherein the one or more remaining combustion zones are located to a downstream side of the first combustion zone, wherein each of the coanda nozzles comprises a predetermined profile disposed proximate to a fuel plenum, wherein the profile is configured to facilitate attachment of a fuel introduced via the fuel plenum to the profile to form a fuel boundary layer and to entrain incoming air from an air inlet to promote premixing of air and fuel.

* * * * *

UNITED STATES PATENT AND TRADEMARK OFFICE

CERTIFICATE OF CORRECTION

PATENT NO. : 8,176,739 B2
APPLICATION NO. : 12/175050
DATED : May 15, 2012
INVENTOR(S) : Evulet et al.

It is certified that error appears in the above-identified patent and that said Letters Patent is hereby corrected as shown below:

In Column 3, Line 55, delete "14." and insert -- 20. --, therefor.

In Column 8, Line 6, in Claim 10, delete "combustion combustor" and insert -- combustor --, therefor.

In Column 9, Line 13, in Claim 14, delete "combustion combustor" and insert -- combustor --, therefor.

In Column 10, Line 21, in Claim 15, delete "a-another" and insert -- another --, therefor.

Signed and Sealed this
Twenty-fourth Day of July, 2012

David J. Kappos
*Director of the United States Patent and Trademark Office*